US005805035A

United States Patent [19]

Accatino et al.

[11] Patent Number: 5,805,035

[45] Date of Patent: Sep. 8, 1998

[54] MULTI-MODE CAVITY FOR WAVEGUIDE FILTERS, INCLUDING AN ELLIPTICAL WAVEGUIDE SEGMENT

[75] Inventors: Luciano Accatino, Rosta; Giorgio Bertin, Turin, both of Italy

[73] Assignee: Cselt-Centro Studi E Laboratori Telecomunicazioni S.p.A., Turine, Italy

[21] Appl. No.: 777,164

[22] Filed: Dec. 26, 1996

[30] Foreign Application Priority Data

Jan. 30, 1996 [IT] Italy ..... TO96A0056

[51] Int. Cl.[6] ..... H01P 1/208

[52] U.S. Cl. ..... 333/208; 333/212

[58] Field of Search ..... 333/202, 208–212, 333/227, 230

[56] References Cited

U.S. PATENT DOCUMENTS

| | | | |
|---|---|---|---|
| 2,424,267 | 7/1947 | Carter | 333/208 |
| 3,235,822 | 2/1966 | De Loach | 333/212 |
| 4,513,264 | 4/1985 | Dorey | 333/212 |
| 4,734,665 | 3/1988 | Rosenberg | 333/21 R X |

FOREIGN PATENT DOCUMENTS

| | | | |
|---|---|---|---|
| 0 687 027 | 12/1995 | European Pat. Off. . | |
| 4116755 | 11/1992 | Germany | 333/208 |
| 0174501 | 9/1985 | Japan | 333/212 |

OTHER PUBLICATIONS

Kuhn, "Microwave bandpass filters . . . 1–dimensional offsets", Circuit theory & applications, vol. 6, No. 1, pp. 13–29, Jan. 1978.

*Primary Examiner*—Seungsook Ham
*Attorney, Agent, or Firm*—Herbert Dubno

[57] ABSTRACT

The cavity has at least one waveguide segment with elliptical cross section whose axes are arranged at a given inclination angle (α) with respect to the polarization of the incident TE field. Thus a dual-mode cavity is realized, with the ability to let resonate two transverse fields (TE) with polarization planes orthogonal to each other. By adding a waveguide element able to introduce a non-axial discontinuity, a triple-mode cavity is obtained, allowing for an additional longitudinal mode to resonate as well.

6 Claims, 3 Drawing Sheets

MULTI-MODE CAVITY FOR WAVEGUIDE FILTERS, INCLUDING AN ELLIPTICAL WAVEGUIDE SEGMENT

SPECIFICATION

FIELD OF THE INVENTION

Our present invention relates to a multimode cavity which comprises at least one waveguide segment and one iris to couple modes into the cavity, which iris identifies with a main axis of the cavity reference plane.

BACKGROUND OF THE INVENTION

A dual-mode cavity with such characteristics is described, for example, in commonly owned EP-A-0 687 027. That previous document can usefully serve as a reference to illustrate the general problems inherent to manufacturing such cavities, particularly with regard to the possibility of making waveguide filters suitable for being completely designed through computer aided design techniques, with no need for specific calibration operations like the ones required by conventional cavities fitted with tuning and coupling screws.

In particular, EP-A-0 687 027 see U.S. Pat. No. 5,703,547 of 30 Dec. 1997 discloses a cavity comprising three coaxial waveguide segments arranged in cascade along the main axis of the cavity. The two end segments (with circular, square or rectangular cross section) allow for two modes to resonate, which modes have linear polarization parallel and respectively perpendicular to a reference plane essentially identified by the diametral plane parallel to the major dimension of the iris used to couple the modes into the cavity. The intermediate segment consists of a waveguide with rectangular cross section whose sides are inclined by a given angle with respect to the aforesaid reference plane.

Such a cavity can be included in a microwave band-pass filter to be used, for instance, in satellite communications.

A dual-mode cavity without tuning and coupling screws is also disclosed in JP-A-60 174501. Elimination of the screws is made possible by the cavity having a rectangular cross section bevelled in correspondence with a corner, or a similarly deformed elliptical cross section. The structure is apparently simpler than that disclosed in EP-A-0 687 027 (U.S. Pat. No. 5,703,547), yet the cross-sectional deformation with respect to an exactly rectangular or elliptical shape results in very great difficulties in numerically analytically modelling the behavior of the cavity. Thus it is very difficult to obtain the required accuracy in the design of the cavity and hence, once the cavity is manufactured, its operation will not be satisfactory.

OBJECT OF THE INVENTION

The object of the present invention is to provide a multi-mode cavity which:

- allows for two or three electromagnetic modes to resonate (with the consequent possibility of using the same cavity several times in making filters, thus reducing the number of geometrical shapes involved);
- does not require coupling; and tuning screws and
- can be easily and very precisely designed and manufactured with computer aided design techniques.

SUMMARY OF THE INVENTION

This object is achieved in a cavity comprising at least one waveguide segment and one iris to couple modes into the cavity, which iris identifies with a main axis of the cavity a reference plane, wherein said waveguide segment is of elliptical cross section and it is arranged so that the axes of said elliptical cross section are inclined by a given angle with respect to said reference plane, said cavity therefore allowing for at least two transverse resonant modes orthogonal to each other, to resonate.

Arranging a cavity inclined with respect to a reference plane is well known in the art. Examples are disclosed in U.S. Pat. No. 3,235,822 (De Loach) and U.S. Pat. No. 4,513,264 (Dorey et al.). Both documents disclose a filter comprising a plurality of cavities each made by a single rectangular waveguide segment, where the waveguide segments may be inclined with respect to one another.

In U.S. Pat. No. 3,235,822 inclination is used to vary the amount of coupling between two adjacent cavities between a maximum and a minimum value. The cavities are strictly single-mode cavities. Increasing the shorter dimension of the rectangular cross section so as to give a nearly-square cross section (as it would be required for dual-mode operation) would result in a loss of control over the transmission characteristics of the filter, making it impossible to obtain useful electrical responses from the filter. Moreover, for very narrow bandwidths, such as the ones the present invention is concerned with, tuning screws are used. In the present invention, inclination of the cavity is one of the features allowing generation and control of coupling between different modes within the cavity without the need for coupling and tuning screws.

In U.S. Pat. No. 4,513,264 the first cavity is aligned with the input field and the inclination of the second cavity is used to generate diagonal couplings between adjacent cavities.

Coupling between the two modes and tuning is obtained by screws. In the present invention, inclination of the first (or the sole) cavity is the feature allowing generation and control of coupling between the modes within the cavity without the need for screws. Elimination of the screws in the filter according to U.S. Pat. No. 4,513,264 would destroy any possibility of operation of the filter since it would cancel coupling between the modes, thus making it impossible for the energy to propagate towards the output. Inclination of that disclosure the first cavity would destroy the equi-ripple character of the passband response of the filter, and then the objects of the invention disclosed in such document cannot be attained.

BRIEF DESCRIPTION OF THE DRAWING

The above and other objects, features, and advantages will become more readily apparent from the following description, reference being made to the accompanying drawing in which.

SPECIFIC DESCRIPTION

The formalism adopted to represent the cavity, indicated as a whole by 1, is wholly similar to that adopted in EP-A-0

687 027 (U.S. Pat. No. 5,703,547). As will be evident to the technician skilled in the art, such a representation shows the geometry of the volume of the cavity itself, which usually is manufactured within a body of conducting, typically metallic, material, with working processes such as turning, electrical discharge machining, etc. The related manufacture criteria are widely known to the skilled worker in the art and do not require to be illustrated specifically herein, especially since they are not in themselves relevant for the purpose of understanding the invention.

It will also be appreciated that, for the sake of clarity, the cavity has been represented in the perspective views by enhancing its extension along the main longitudinal axis (axis 2) with respect to the actual constructive embodiment: differently stated, in practice, the cavity will usually be longitudinally "squashed" with respect to the shape shown. It should in any case be specified that the lengths of the individual sections of the cavity constitute design parameters for the cavity itself, as is well known.

Figure 1:
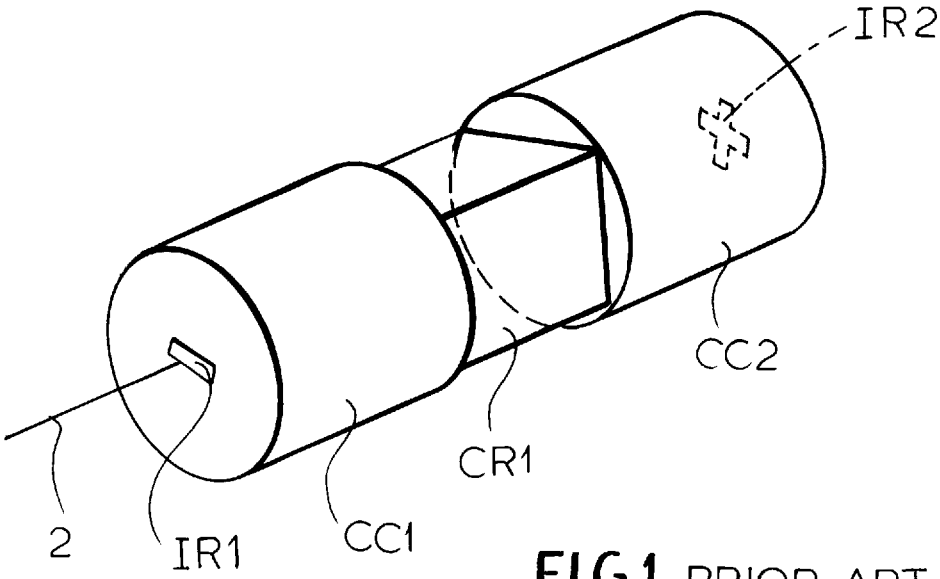
FIG.1 PRIOR ART
FIG. 1 is a perspective view of a prior art cavity according to EP-A-0 687 027.

FIG. 1 depicts a dual-mode cavity for making microwave band-pass filters, like that disclosed in EP-A-0 687 027 (U.S. Pat. No. 5,703,547). In short, that cavity comprises three coaxial waveguide segments arranged in cascade along the main cavity axis 2. Specifically, there is a first waveguide element CC1 with circular cross section followed by a second waveguide element CR1 with rectangular cross section and then by a third waveguide element CC2, again with circular cross section. Reference IR1 indicates an iris allowing coupling of the modes into cavity 1, and reference IR2 indicates an iris arranged so as to couple multiple modes simultaneously (for instance a cross-shaped iris) located at the opposite end of cavity 1. Iris IR2 allows coupling of cavity 1 with a cavity (identical or different, not shown), arranged in cascade, to make a microwave filter.

The presence of waveguide segment CR1 with rectangular cross section, the sides of which are inclined by a given angle with respect to a reference plane which passes through axis 2 and is parallel to the major dimension of iris IR1 and of the horizontal element of iris IR2, makes the cavity shown in FIG. 1 able to allow for two electromagnetic resonating modes. Such modes are transverse with respect to axis 2 and have polarization planes respectively parallel and orthogonal with respect to the aforesaid reference plane. The non-homogeneous cross-sectional shape of the cavity along axis 2 (and the resulting discontinuity) allows tuning and coupling screws to be dispensed with. For a more precise description of the manufacturing criteria of this known cavity, particularly in regard to the possibility of replacing circular segments CC1 and CC2 with segments having square or rectangular cross sections, reference can be made to the specification of EP-A-0 687 027 (U.S. Pat. No. 5,703,547).

Figure 2:
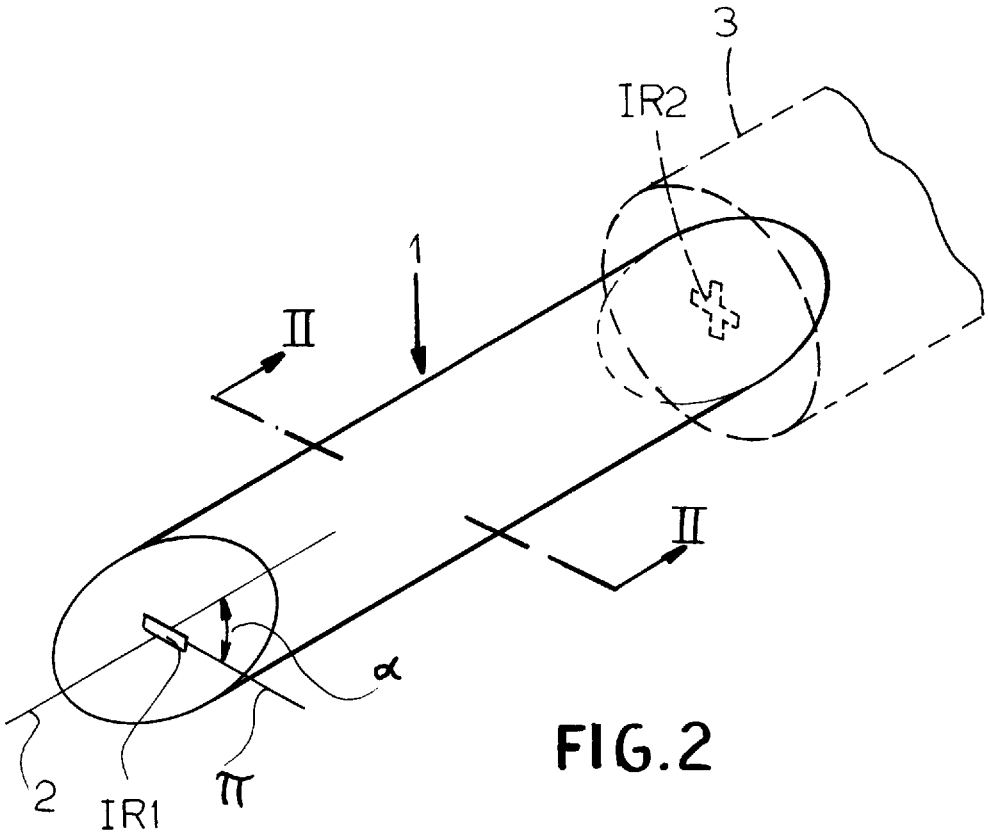
FIG. 2 is a perspective view of a cavity according to the invention.
Figure 3:
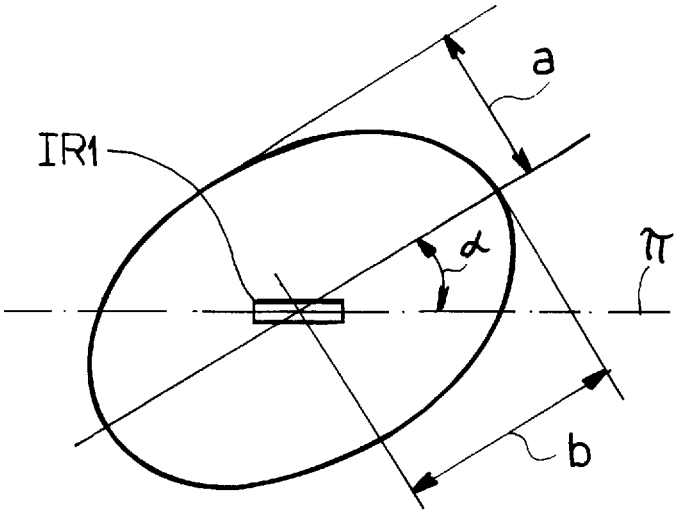
FIG. 3 is a cross-sectional view taken along line II—II in FIG. 2.

The solution according to the present invention is based on the the fact that a dual-mode operation wholly similar to the one attained in the prior art solution depicted in FIG. 1 can be obtained with the cavity having the structure shown in FIG. 2. That cavity, still denoted by reference numeral 1, comprises a waveguide segment with elliptical cross section, with semiaxes a, b arranged at an angle with respect to the reference plane, as illustrated in greater detail in the sectional view of FIG. 3, where the reference plane, denoted $\pi$, is identified by the trace of its intersection with the plane of the sheet.

Applicant's experiments have demonstrated that the coupling and tuning of the two TE resonant modes of the cavity, orthogonal to each other, can be defined with a high degree of precision in the course of the design (typically by using a computer) and then directly obtained during manufacturing, without need for adjustments, by controlling the value of the inclination angle ($\alpha$), the ratio between semiaxes a and b ("aspect ratio") and the length of the waveguide segment with elliptical cross-section.

Cavity 1 can be coupled, for example through iris IR2, with another cavity 3, also with elliptical cross section (whose profile is sketched in dashed lines in FIG. 2), with a different inclination angle a from that of cavity 1. Thus, a microwave filter comprising multiple resonant cavities coupled with each other can be made according to known criteria.

The invention illustrated in FIG. 2 can be further developed to give rise to a triple-mode cavity, i.e. a cavity with the ability to make resonate, in addition to the two TE modes mentioned previously, also a third TM mode with electrical field polarization directed along the main axis 2 of cavity 1 and orthogonal to the previous ones. This result can be obtained, see copending application Ser. No. 08/777,163 filed 26 Dec. 1996 application filed on the same date by the same Applicant, by providing a waveguide element (comprising a waveguide segment or an iris) which introduces a non-axial discontinuity typically near one end of the cavity.

Figure 4:
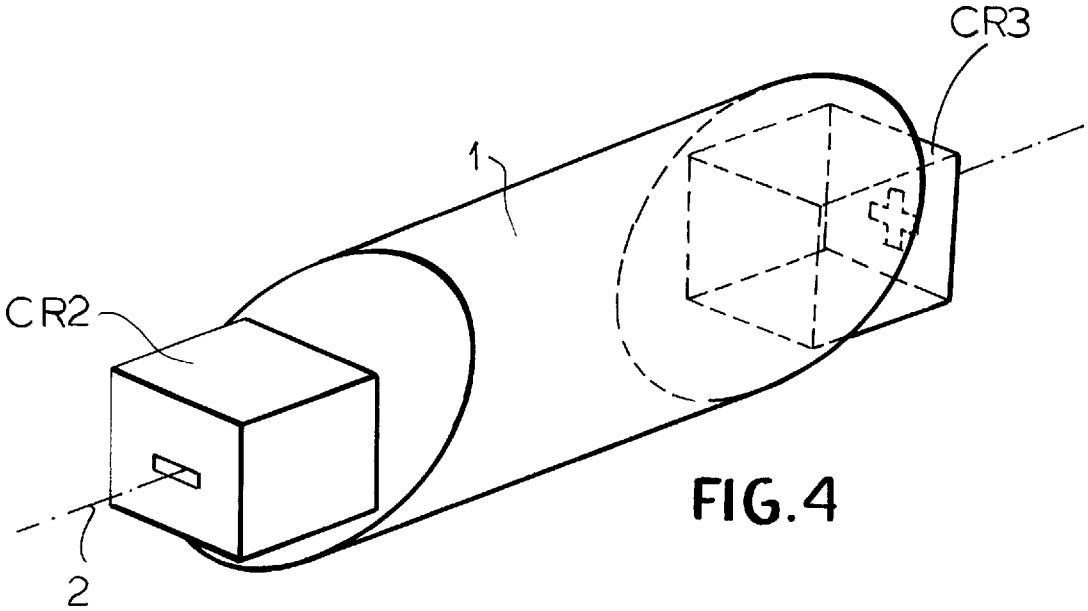
FIGS. 4 and 5 depict the application of the invention to the manufacture of a triple-mode cavity.

In a first embodiment of the triple-mode cavity according to the invention, shown in FIG. 4, this is obtained by providing, at one or both ends of an elliptical waveguide segment like the one constituting dual-mode cavity 1 shown in FIG. 2, a rectangular waveguide segment (the term "rectangular" also includes, as a particular case, a square cross section) arranged eccentrically (i.e. asymmetrically or off-axis) with respect to axis 2: in other words, that segment is arranged in such a way that at least one of the ideal median planes dividing in half the sides of the cross section of the waveguide segment itself is spaced apart by a predetermined offset amount ($a_{off}$) from main axis 2 of the cavity, and in particular from reference plane $\alpha$.

By way of example, FIG. 4 shows the case of two waveguide segments CR2, CR3 with rectangular cross section located at the two ends of an elliptical waveguide segment 1. Should the application make it advisable, one of the rectangular segments might be arranged along the body of cavity 1, in an intermediate position between two elliptical segments. The or each rectangular waveguide segment can be oriented so that its sides are respectively parallel and perpendicular to reference plane $\alpha$.

In an alternative, the or each eccentric segment could have circular or elliptical cross section.

Figure 5:
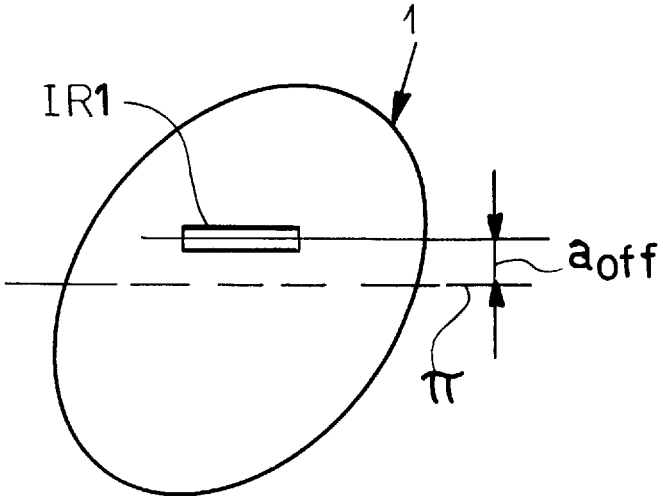

In a second embodiment of the triple-mode cavity according to the invention, shown in FIG. 5, the waveguide element that introduces a non-axial discontinuity is iris IR1 arranged eccentrically (i.e. asymmetrically or off-axis) with respect to axis 2, that is to say (as can be seen in the drawing) in such a way that the intersection point of the diagonals of the iris is displaced by a predetermined amount $a_{off}$ with respect to the main axis of the elliptical cavity.

In the case of the triple-mode cavity, too, it is possible to couple cavity 1 with at least another cavity to make a filter.

Of course, while maintaining unchanged the principles of the invention, construction details and the embodiments of invention may be widely varied with respect to what has been described and illustrated, without departing from the scope of the present invention. This applies in particular to the possible loading of the cavity with a dielectric element in order to reduce the resonance frequency or the volume of the cavity. In any case, coupling the orthogonal modes by means of a waveguide segment with elliptical cross section allows easy modelling and mechanical manufacturing of the cavity and of the related filter. In particular, very accurate computation algorithms exist to analyze the cavity elements described herein as a function of the related parameters (aspect ratio a/b, inclination angle a, etc.). Thus it is possible to use algorithms to obtain the complete design of the dimensions of the cavity, with no further need for tuning the device thus manufactured.

Figure 6:
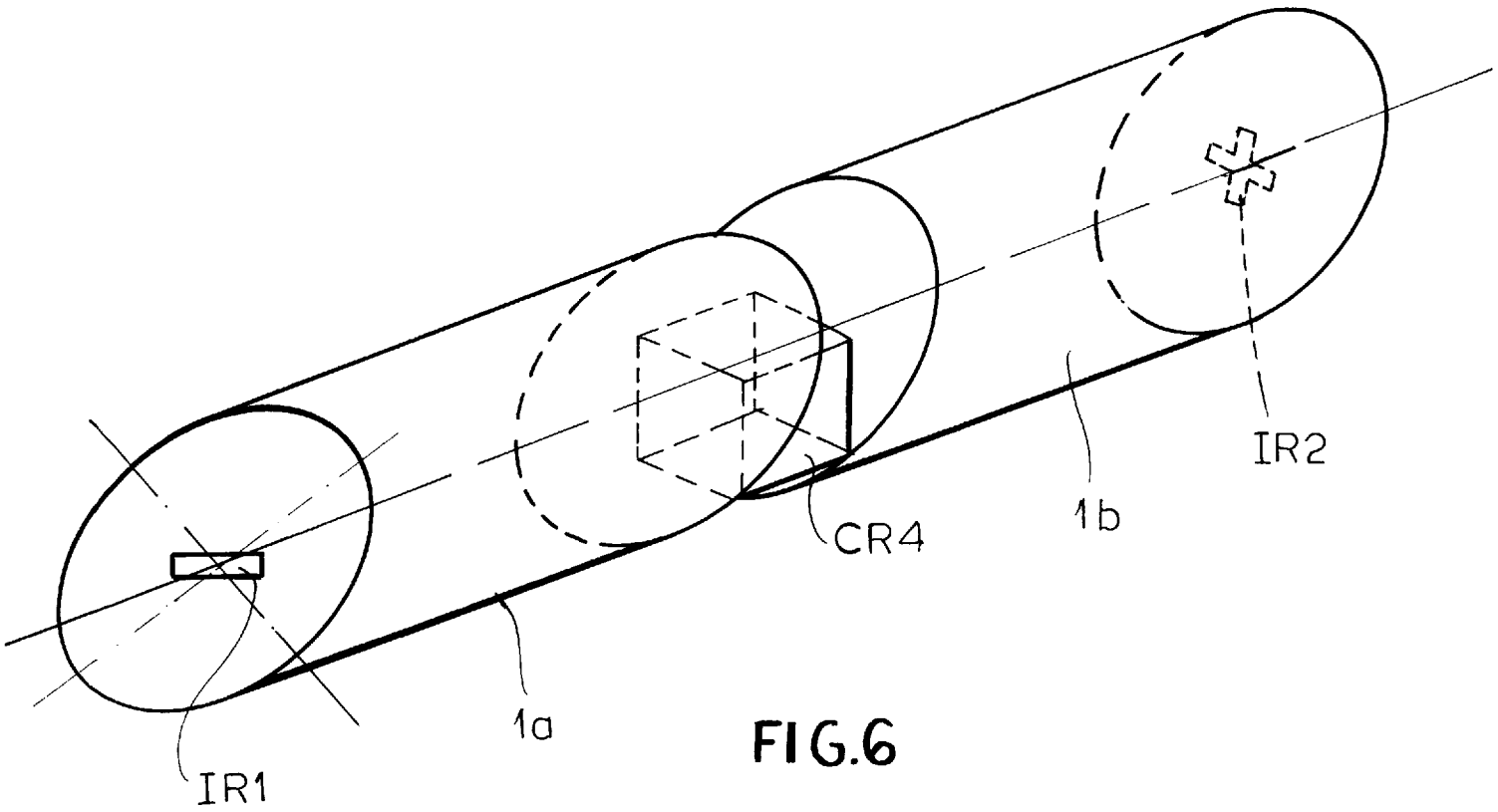
FIG. 6 shows another cavity according to the invention in a perspective view.

FIG. 6 shows a cavity wherein the waveguide element arranged generally eccentrically is shown at CR4 located in an intermediate position between waveguide segments 1*a* and 1*b* with elliptical cross section.

We claim:

1. A resonant cavity free from tuning screws for waveguide filters, the cavity comprising at least one waveguide segment and one iris to couple modes into the cavity, said iris forming with a main axis of the cavity a reference plane, said waveguide segment having an elliptical cross section and being arranged so that an axis of said elliptical cross section is inclined by a given angle with respect to said reference plane to allow for at least two transverse resonant modes, orthogonal to each other, to resonate.

2. The cavity as defined in claim 1 further comprising at least one waveguide element axially aligned with the cavity but generally arranged eccentrically with respect to the main axis of the cavity, so that said cavity allows for at least one additional resonant mode to resonate in addition to said two transverse resonant modes, said additional mode having a longitudinal polarization of the electrical field.

3. The cavity defined in claim 2 wherein said waveguide element arranged generally eccentrically is at least one additional waveguide segment with rectangular cross section, arranged so that its sides are respectively parallel and orthogonal with respect to said reference plane.

4. The cavity defined in claim 2, wherein said waveguide element arranged generally eccentrically is an additional waveguide segment located at least at one end of said waveguide segment (1) with elliptical cross-section.

5. The cavity defined in claim 2 wherein said at least one waveguide element arranged generally eccentrically is an additional waveguide segment located in an intermediate position between waveguide segments with elliptical cross section.

6. The cavity defined in claim 2, wherein said waveguide element arranged generally eccentrically comprises an iris for coupling modes into the cavity.

* * * * *